United States Patent [19]

Matsuda

[11] 4,047,265

[45] Sept. 13, 1977

[54] FASTENER STRINGER

[75] Inventor: Yoshio Matsuda, Nyuzen, Japan

[73] Assignee: Yoshida Kogyo Kabushiki Kaisha, Japan

[21] Appl. No.: 660,374

[22] Filed: Feb. 23, 1976

[30] Foreign Application Priority Data

Feb. 28, 1975 Japan ..... 50-25365

[51] Int. Cl.[2] ..... A44B 19/10; D04B 23/12

[52] U.S. Cl. ..... 24/205.16 C; 66/195

[58] Field of Search ..... 24/205.16 C

[56] References Cited

U.S. PATENT DOCUMENTS

| | | | |
|---|---|---|---|
| 3,714,683 | 2/1973 | Frohlich | 24/205.16 C |
| 3,757,541 | 9/1973 | Frohlich | 24/205.16 C |
| 3,840,946 | 10/1974 | Frohlich | 24/205.16 C |
| 3,849,842 | 11/1974 | Yoshida | 24/205.16 C |
| 3,922,760 | 12/1975 | Matsuda | 24/205.16 C |

*Primary Examiner*—Bernard A. Gelak
*Attorney, Agent, or Firm*—Bucknam and Archer

[57] ABSTRACT

A sliding clasp fastener stringer is disclosed which comprises a warp-knit support tape carrying a row of interlocking fastener elements, said tape having a web portion of a relatively coarse interstice structure suitable for stitching the tape to an article of clothing, and a longitudinal edge portion formed solely by knit-loop forming threads suitable for mounting the row of fastener elements stably into position thereon against displacement relative to the tape. The web portion and the edge portion are interconnected transversely by a connecting portion which is formed by threads merging from both of said portions and which has a relatively fine interstice structure.

5 Claims, 5 Drawing Figures

FASTENER STRINGER

BACKGROUND OF THE INVENTION

1. Field of the Invention

This invention relates to a sliding clasp fastener and more particularly to a stringer of a warp-knit structure therefor which carries along one longitudinal edge a row of interlocking fastener elements.

2. Prior Art

Warp-knit tapes are known which are suitable for use as support tapes for sliding clasp fasteners. They comprised a variety of knit patterns but required reinforcement of their longitudinal edges at which the fastener elements were to be mounted, for stabilizing the mounted elements against displacement relative to the tapes. Such reinforcement was made in the prior art with the use of additional laid-in yarns, stranded or otherwise bulky yarns. While it was thus necessary to reinforce the warp-knit fastener tapes from the point of view of the functioning of interlocking fastener elements, it would be equally important to ensure that the fastener be sewn to an article of clothing smoothly without encountering puckered or shrunk stitches.

SUMMARY OF THE INVENTION

With the foregoing in view, it is an object of the present invention to provide an improved knit fastener stringer which will accomplish the dual purposes of providing sufficient positional stability of the fastener elements and facilitating the sewing of the stringer onto a garment fabric without resultant puckering or shrinkage.

It is another object of the invention to provide an improved fastener stringer which is highly resistant to stresses, particularly to lateral pull exerted during use of the fastener.

Briefly stated, the above objects of the invention are accomplished by the provision of a fastener stringer comprising a warp-knit tape and a row of interlocking fastener elements mounted thereon, said tape having a web portion of a relatively coarse interstice structure, a longitudinal edge portion consisting solely of knit-loop forming threads for mounting said row of fastener elements, and a connecting portion of a relatively fine interstice structure interconnecting said web portion and said edge portion transversely of the tape, said connecting portion being formed by threads constituting said web portion and said edge portion, respectively.

The invention will be better understood from the following description taken in connection with the accompanying drawing which illustrates by way of example certain preferred embodiments which the invention may assume in practice and in which like reference characters refer to like or corresponding parts throughout the several views.

DETAILED DESCRIPTION OF THE PREFERRED EMBODIMENTS

Figure 1:
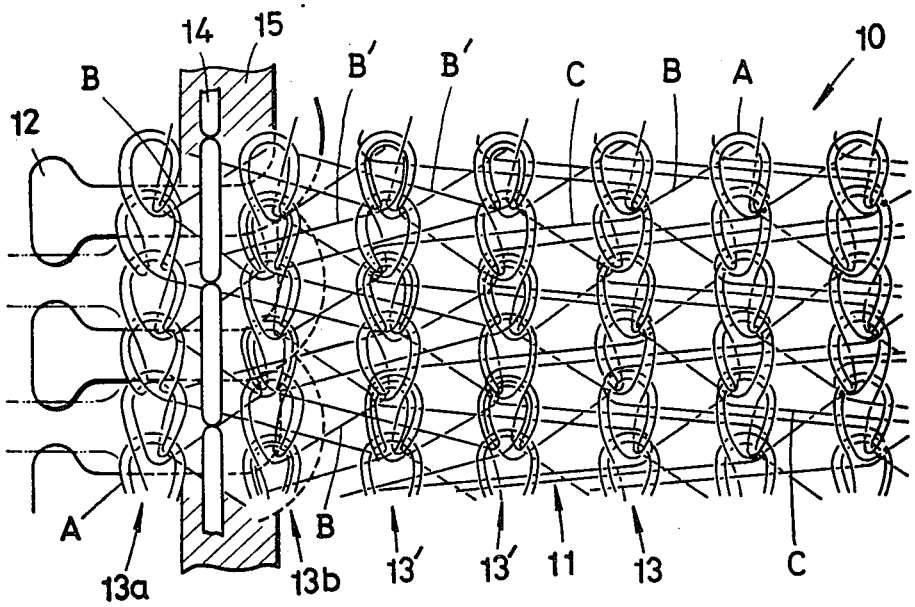
FIG. 1 is a diagrammatic fragmentary view on enlarged scale of a reverse side of a fastener stringer embodying the invention.
Figure 2:
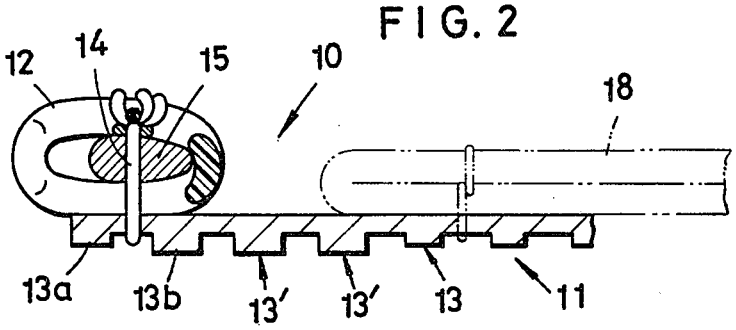
FIG. 2 is a transverse cross-sectional view on reduced scale of the stringer tape of FIG. 1 schematically shown secured to a garment.
Figure 3:
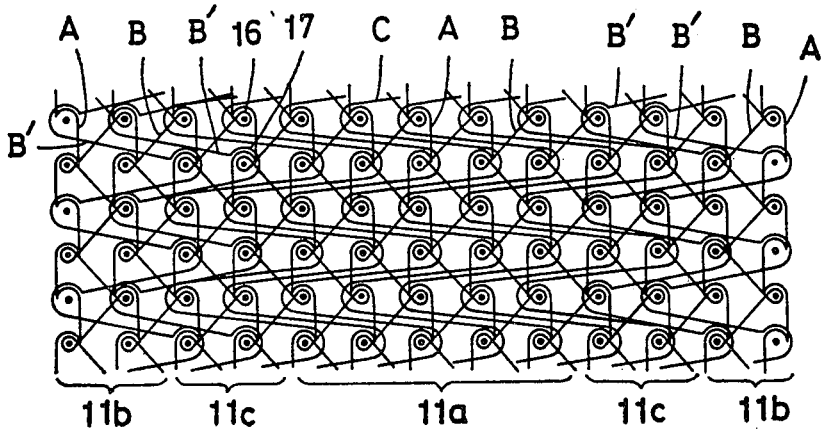
FIG. 3 is a diagram illustrating the knit construction of the stringer tape of FIGS. 1 and 2.

Referring now to the drawing and FIGS. 1 to 3 in particular, there is shown one of a pair of fastener stringers generally designated 10 which comprises a warp-knit support tape 11 and a row of interlocking fastener elements 12 mounted on the longitudinal edge of the tape 11. The support tape 11 consists of a warp-knit structure which has, as better shown in FIG. 3, a web portion **11*a* occupying a majority of the tape areas, a longitudinal edge portion 11*b* defining a selvage of the tape, and a connecting portion 11*c* interconnecting the web portion 11*a* and the edge portion 11*b* transversely of the tape 11. The web portion 11*a* is formed by chain stitches A, defining a multiplicity of longitudinal wales 13 aligned in parallel, tricot stitches B extending diagonally across and between two adjacent wales 13, and laid-in lapping threads C extending over and connecting every three wales 13**. This knit system provides a rather coarse interstice structure.

According to an important aspect of the invention, the longitudinal edge portion **11*b* of the support tape 11 is formed solely by knit-loop forming threads; i.e. a chain stitch A, a first tricot stitch B spanning every two wales and a second tricot stitch B′ spanning every three wales. The knit system of this tape portion is thus rendered rigid enough to anchor the fastener elements 12** stably into position thereon with uniform strength, irrespective as to whether the elements are mounted on the courses or not.

Designated at 14 in FIGS. 1 and 2 is a line of stitching extending between the first or outermost wale **13*a* and the second or adjoining wale 13*b* at the edge portion 11*b* and securing the fastener elements 12 thereat to the tape 11 through the medium of a filler cord 15**.

According to another important aspect of the invention, the connecting portion **11*c* of the tape 11 is formed by the combination of knitting threads constituting the web portion 11*a* and the edge portion 11*b*, respectively, as better shown in FIG. 3 so that the interstice structure at this region of the tape is rendered dense as compared to that of the web portion 11*a*. More specifically, the connecting portion 11*c* includes a group of double knit-loops 16 alternating warp-wise with a group of triple knit-loops 17, with the wales 13′ formed thereby being bulkier than the remaining wales 13**, as better shown in FIG. 2.

The fastener stringer 10 thus constructed has the advantage that when severe lateral stresses are applied to the tape 11, such stresses can be absorbed at densely knitted connecting portion **11*c* and prevented from affecting the alignment of the fastener elements 12. Also advantageously, the connecting portion 11*c* cooperates with the edge portion 11*b* in maintaining these regions of the tape 11 sufficiently rigid and robust to retain the row of fastener elements 12 in place against shifting out of alignment or disturbing the element-to-element spacing or pitch when the stringer 10 is subjected to forces tending to bend or thrust it, which forces would otherwise develop irregular elongation and shrinkage at the areas of the tape 11** at which the fastener elements are located.

Further advantageously, when sewing the stringer 10 to an article of clothing 18 as shown in FIG. 2, this can be accomplished without causing the tape 11 to pucker or shrink under the influence of sewn stitches. This is because the web portion 11*a* is constructed less bulky with coarse interstices to make this portion of the tape 11 yieldable to sewing pressure and readily dissipate the puckering or shrinkage of the tape 11 which results from stitch holes formed upon passage of the sewing needles.

Figure 4:
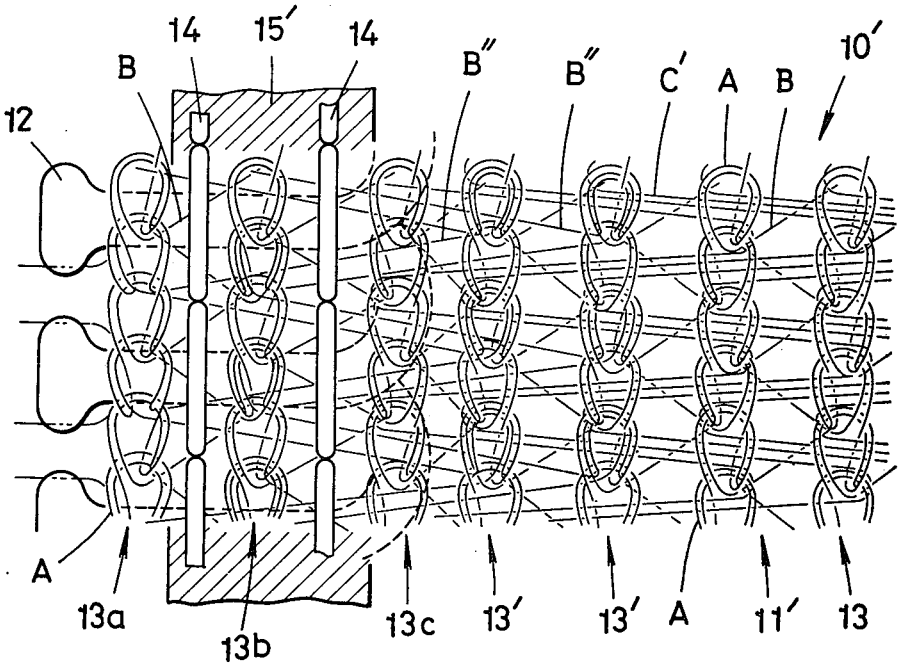
FIG. 4 is a view similar to FIG. 1 but showing a modification of fastener stringer according to the invention.
Figure 5:
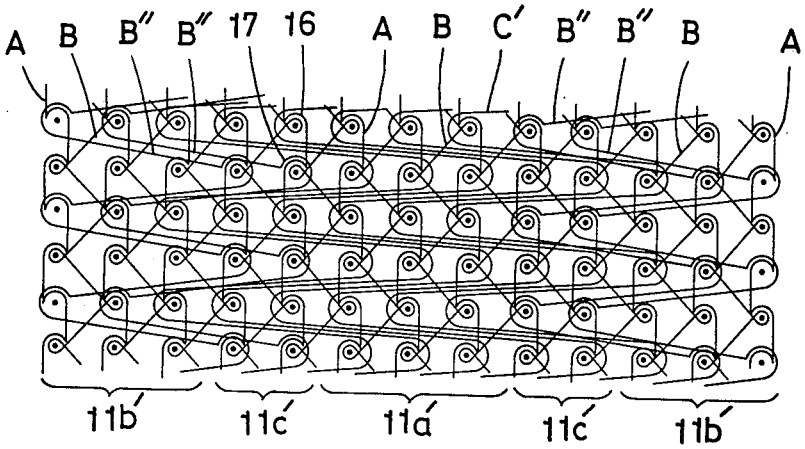
FIG. 5 is a diagram illustrating the knit construction of the stringer tape of FIG. 4.

Reference now to FIGS. 4 and 5 shows a modification of fastener stringer 10' according to the invention wherein the knit construction of the tape 11' is basically the same as the above-described embodiment except that both the second tricot stitches B'' and the laid-in lapping threads C' are arranged to span every four wales and that the fastener elements 12 are secured to the edge portion 11*b'* of the tape 11 by two lines of stitchings 14, one of which extends between the first wale 13*a* and the second wale 13*b'* and the other between the second wale 13*b* and the third wale 13*c*. This fastener stringer 10 may be suitable for mounting a relatively large fastener element row.

What is claimed is:

1. A fastener stringer which comprises a warp-knit tape and a row of interlocking fastener elements secured thereto by a line of stitching, said tape having a web portion of a relatively coarse interstice structure, a longitudinal edge portion consisting solely of knit-loop forming threads and bearing said row of fastener elements, and a connecting portion of a relatively fine interstice structure interconnecting said web portion and said edge portion transversely of the tape, said connecting portion being formed by threads constituting said web portion and said edge portion, respectively, the knit-loop forming threads of said longitudinal edge portion including chain stitches defining plural parallel longitudinal wales, a first tricot stitch spanning a plurality of wales, and a second tricot stitch spanning a greater plurality of wales than spanned by said first tricot stitch.

2. A fastener stringer as claimed in claim 1 wherein said web portion is formed by chain stitches defining longitudinally extending wales, tricot stitches extending diagonally across and between a plurality of adjacent wales, and laid-in lapping threads extending over and connecting a plurality of three or four wales.

3. A fastener stringer as claimed in claim 1 wherein said first tricot stitch spans every two wales and said second tricot stitch spans at least three wales.

4. A fastener stringer as claimed in claim 1 wherein said connecting portion includes a group of double knit-loops and a group of triple knit loops alternating warp-wise therewith.

5. A fastener stringer as claimed in claim 1 wherein said row of fastener elements is secured to said tape by two lines of stitching.

* * * * *